US009055358B2

(12) United States Patent
Sato et al.

(10) Patent No.: US 9,055,358 B2
(45) Date of Patent: Jun. 9, 2015

(54) SPEAKER DEVICE

(71) Applicant: GEM Impact Inc., Tokyo (JP)

(72) Inventors: Yutaka Sato, Kanagawa (JP); Norio Nagai, Niigata (JP); Norihiko Hibino, Tokyo (JP); Aiko Hibino, Tokyo (JP)

(73) Assignee: GEM Impact Inc., Tokyo (JP)

( * ) Notice: Subject to any disclaimer, the term of this patent is extended or adjusted under 35 U.S.C. 154(b) by 0 days.

(21) Appl. No.: 14/199,826

(22) Filed: Mar. 6, 2014

(65) Prior Publication Data

US 2014/0341401 A1 Nov. 20, 2014

(30) Foreign Application Priority Data

May 15, 2013 (JP) ..... 2013-103005

(51) Int. Cl.
*H04R 5/00* (2006.01)
*H04R 1/02* (2006.01)

(52) U.S. Cl.
CPC ..... *H04R 1/02* (2013.01)

(58) Field of Classification Search
None
See application file for complete search history.

(56) References Cited

U.S. PATENT DOCUMENTS

| | | | | |
|---|---|---|---|---|
| 3,970,804 | A * | 7/1976 | O'Brien et al. | 381/120 |
| 6,122,390 | A | 9/2000 | Rosswork | |
| 8,472,645 | B2 * | 6/2013 | Wang | 381/152 |
| 2005/0244016 | A1 * | 11/2005 | Norris et al. | 381/77 |
| 2008/0127606 | A1 * | 6/2008 | Kuroiwa | 52/784.14 |

FOREIGN PATENT DOCUMENTS

| | | | | |
|---|---|---|---|---|
| JP | 57-036084 | A | 2/1982 | |
| JP | 57-36084 | U | 2/1982 | |
| JP | 57-041391 | A | 3/1982 | |
| JP | 57-41391 | U | 3/1982 | |
| JP | 63-254894 | B2 | 10/1988 | |
| JP | 63-254897 | B2 | 10/1988 | |
| JP | 64-029097 | B2 | 1/1989 | |
| JP | 2005-159409 | A | 6/2005 | |
| JP | 2005159409 | * | 6/2005 | H04R 9/04 |
| JP | 2007-019623 | A | 1/2007 | |
| JP | 2007-336337 | A | 12/2007 | |
| WO | 2011/004479 | A1 | 1/2011 | |

* cited by examiner

*Primary Examiner* — Curtis Kuntz
*Assistant Examiner* — Julie X Dang
(74) *Attorney, Agent, or Firm* — Seed IP Law Group PLLC

(57) ABSTRACT

A speaker device including: a hollow case; a drive unit housed in the case and configured to cause a diaphragm to vibrate; and a curved diaphragm having a flat plate curved and arranged to stand in an upright position on an upper surface of the case, wherein a diaphragm of the drive unit is exposed at a part of a surface of the case, and a part of a base end of the curved diaphragm abuts on the diaphragm of the drive unit, and the curved diaphragm is compressively deformed through a standing pole arranged to extend between a tip end of the curved diaphragm and the case, whereby vibration of the diaphragm of the drive unit is allowed to propagate to the curved diaphragm and the case so that sound is allowed to come out of the diaphragm of the drive unit, the curved diaphragm, and the case.

6 Claims, 4 Drawing Sheets

SPEAKER DEVICE

CROSS REFERENCE TO RELATED APPLICATIONS

This application claims the benefit of priority upon Japanese Patent Application No. 2013-103005 filed on May 15, 2013, of which full contents are incorporated herein by reference.

BACKGROUND OF THE INVENTION

1. Field of the Invention

The present invention relates to a speaker device configured to generate a transverse wave.

2. Description of the Background Art

There has long been known a speaker device each having a plurality of horn-shaped, cone-shaped speakers responsive to different audio frequency ranges (low-frequency range, mid-frequency range, high-frequency range) attached to a baffle plate on the front surface of a speaker box thereof.

A plane-shaped speaker device without a speaker box has also been disclosed in patent document 1 (Japanese patent publication No. H4-64240) and patent document 2 (Japanese patent publication No. H3-79920).

The plane-shaped speaker device has been configured such that a sheet-like diaphragm having the front surface thereof fixedly attached with a plurality of ribs is maintained at a bending state of the diaphragm thereof, and such that the diaphragm is causes to vibrate through a plurality of voice coils having different audio frequency ranges provided in a dotted pattern on the back surface of the diaphragm curved by bending.

Due to the fact that the plurality of ribs hinder vibration of the sheet-like diaphragm, it has been well known that the speaker made of the sheet-like diaphragm is lower in performance in reproducing a high-frequency range and a low-frequency range than in reproducing a mid-frequency range.

It has been proposed in patent document 3 (Japanese patent No. 2510607) that a plane-shaped speaker device having an opening formed in the center of a sheet-like diaphragm as well as having added thereto a cone-shaped speaker dedicated to a high-frequency range in the opening configured to reinforce performance in reproducing a high-frequency range.

A conventional speaker device had the following problems:

[1] A speaker device attached with a plurality of horn-shaped, cone-shaped speakers is suitable for reproduction of a plurality of audio frequency ranges, and is characteristic of high directivity of sound; however, the speaker device generates a compression wave (longitudinal wave) in the air. As a result, there has occurred a problem that a compression wave (longitudinal wave) in the air worsens propagation properties of sound and therefore sound is attenuated in proportion to a distance, and that interference of a compression wave occurs.

In addition, a compression wave (longitudinal wave) in the air emitted as sound from the speaker device has rendered conversation as being difficult in a loud-sound environment.

[2] A plane-shaped speaker device can be compact in size; however, it is low in performance in reproducing a high-frequency range and a low-frequency range.

For example, sound having a high-frequency range such as that in music played with a stringed instrument and that in an opera may become opaque easily and cannot be reproduced clearly. In addition, sound having a low-frequency range such as drum sound and base sound is hard to reproduce.

[3] For a plane-shaped speaker device obtained by combining a sheet-like diaphragm and a publicly-known cone-shaped speaker, it has been technically difficult to adjust a balance of a sound volume between the cone-shaped speaker and the sheet-like diaphragm.

[4] For a plane-shaped speaker device, there still remains a problem that a maximum sound volume thereof is lower than that achieved by a cone-shaped speaker.

Increase in the sound volume of the plane-shaped speaker device beyond limits thereof has caused sound clipping (the so-called, chattering noise) to occur.

[5] For the reasons provided above, many problems have still been left as being unsolved with respect to a plane-shaped speaker device, which has delayed practical use thereof.

The present invention has been made to solve the above problems, and the object thereof is to provide at least one of the following speaker devices:

[1] the speaker device capable of emitting sound having a mid and high-frequency range as well as sound having a low-frequency range, at high quality, while a component count is suppressed;

[2] the speaker device for which effective use can be made of a drive unit thereof;

[3] the speaker device having a sound volume increased by enhancing bending deformation performance of a diaphragm thereof;

[4] the speaker device having a high degree of healing and peace-of-mind effects; and

[5] the speaker device added with a high value having the function as an interior ornament as well.

SUMMARY OF THE INVENTION

The present invention is a speaker device comprising: a case having a hollow structure; at least one drive unit housed in the case, the at least one drive unit configured to cause a diaphragm to vibrate; and at least one curved diaphragm having a flat plate curved and arranged to stand in an upright position on an upper surface of the case, wherein said speaker device is configured such that the diaphragm of the at least one drive unit is exposed at a part of a surface of the case, and that a part of a base end of the at least one curved diaphragm abuts on the diaphragm of the at least one drive unit, and the at least one curved diaphragm is compressively deformed through a standing pole arranged to extend between a tip end of the at least one curved diaphragm and the case, whereby vibration of the diaphragm of the at least one drive unit is allowed to propagate to the at least one curved diaphragm and the case, so that sound is allowed to come out of the diaphragm of the at least one drive unit, the at least one curved diaphragm, and the case.

Further, in the above speaker device as another aspect of the present invention, sound having a mid-frequency range and a high-frequency range may be emitted through the at least one curved diaphragm, and sound having a low-frequency range may be emitted through the case by use of reaction generated during vibration of the diaphragm of the at least one drive unit.

Still further, in the above speaker device as another aspect of the present invention, the at least one curved diaphragm and the case may be made of a wood plate, and the wood plate may include a multilayered body having a plurality of thin plates and a plurality of reinforcing sheets each interposed between thin plates of the plurality of thin plates.

Still further, in the above speaker device as another aspect of the present invention, the plurality of thin plates may be made of paulownia wood material, and the plurality of reinforcing sheets may be made of Japanese paper.

Still further, in the above speaker device as another aspect of the present invention, the at least one curved diaphragm may be shaped as a substantially triangular sail, and the case may be shaped as a hull, whereby said speaker device may be shaped as a sailing ship.

According to the present invention, at least one of the following effects could be achieved:

[1] Sound having a high-frequency range and a low-frequency range, which was hardly emitted previously, can be emitted clearly through the compressively deformed at least one curved diaphragm, the case, and the diaphragm of the at least one drive unit.

As a result, a horn-shaped, cone-shaped speaker that was added to a conventional speaker device can be omitted.

[2] By use of one drive unit, sound can be emitted from the at least one curved diaphragm, the case, and the diaphragm of the one drive unit.

As a result, there are achieved not only the effects that effective use can be made of the one drive unit to reduce a component count but also the effects that sounds from the at least one curved diaphragm, the case, and the diaphragm of the one drive unit do not interfere with each other unlike a conventional speaker device, and therefore, sound having low-frequency, mid-frequency, and high-frequency ranges can be reproduced clearly and performance in reproducing sound can be remarkably enhanced.

[3] The at least one curved diaphragm and the case are made of a wood plate including a multilayered body having a plurality of thin plates and a plurality of reinforcing sheets each interposed between thin plates of the plurality of thin plates. As a result, prevention of a crack of the wood plate as well as favorable bending deformation performance of the wood plate can be achieved in a compatible fashion.

Accordingly, the at least one curved diaphragm and the case can be formed into arbitrary shapes by using the wood plate.

[4] The at least one curved diaphragm and the case are made of a curved wood plate. As a result, there are achieved not only the effects that a sound volume is increased but also the effects that the absence of a vibration attenuating member such as a reinforcing rib enhances vibration feature of the wood plate to allow clear sound without opaqueness to be emitted.

[5] The speaker device according to the present invention enables a person to perceive sound of an ultra-high frequency range, via the body (skin) thereof, whose sound cannot be perceived via the ears thereof.

In particular, by using paulownia wood material for making the at least one curved diaphragm and the case, a degree of healing and peace-of-mind effects are further increased.

[6] By forming the speaker device in a sailing-ship shape, the speaker device is allowed to have the function as an interior ornament of a sailing ship as well.

BRIEF DESCRIPTION OF THE DRAWINGS

For more thorough understanding of the present invention and advantages thereof, the following descriptions should be read in conjunction with the accompanying drawings, in which.

DESCRIPTION OF EMBODIMENTS OF THE INVENTION

Hereinafter, embodiments according to the present invention will be described in detail by referring to FIGS. 1 to 4.

[1] Outline of Speaker Device

Figure 1:
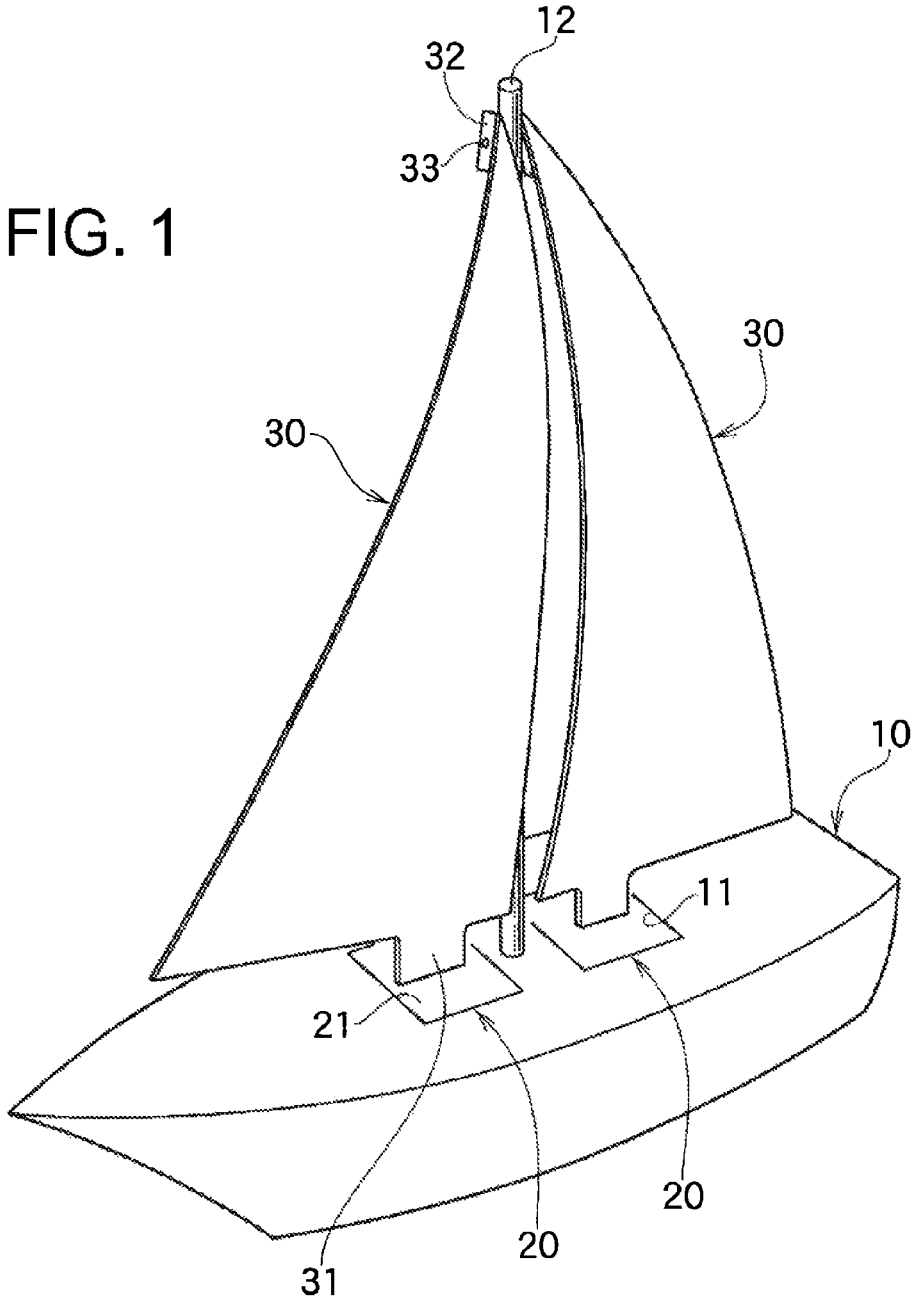
FIG. 1 depicts a perspective view of a speaker device of the present invention.
Figure 2:
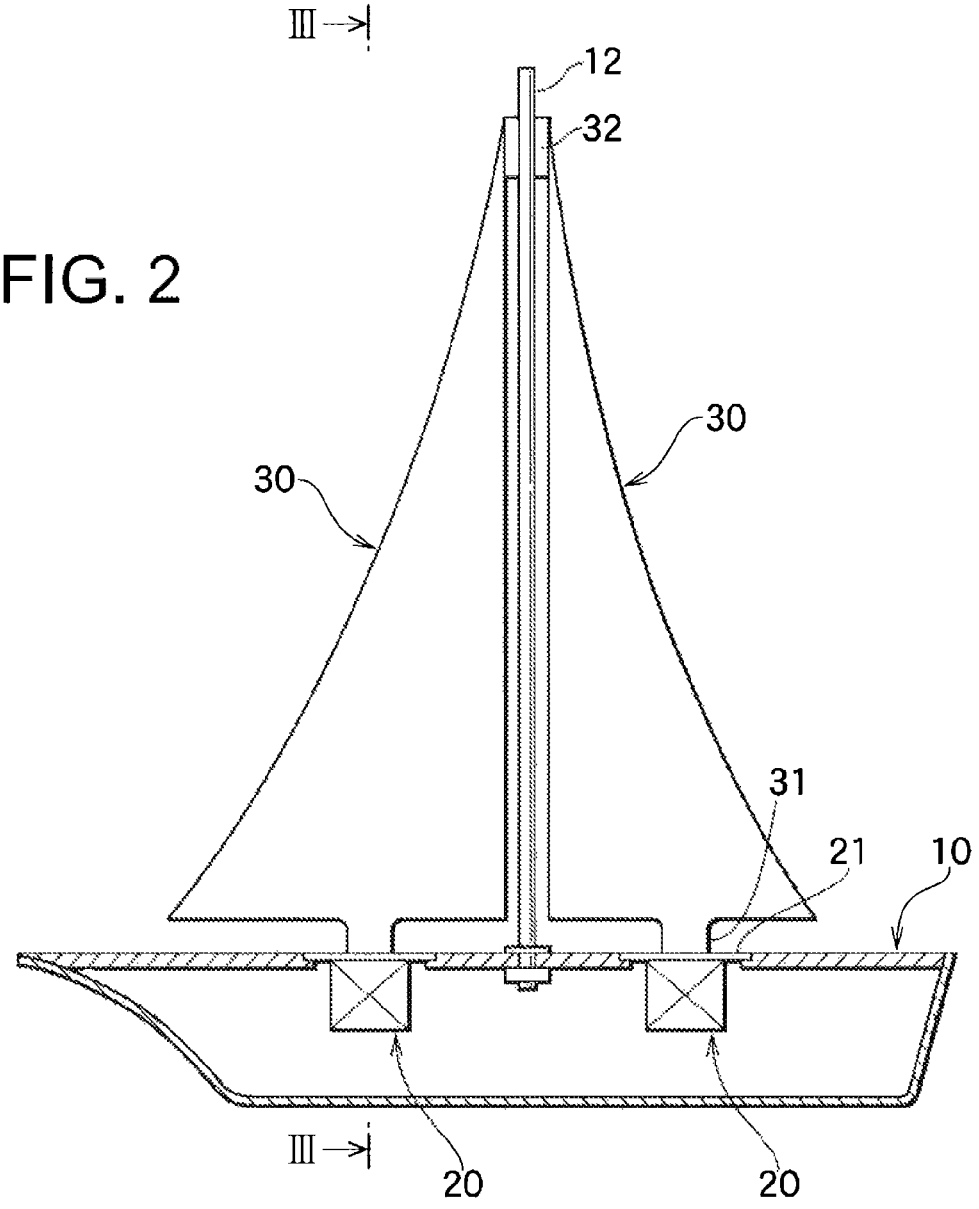
FIG. 2 depicts a central and vertical cross-sectional view of the speaker device.
Figure 3:
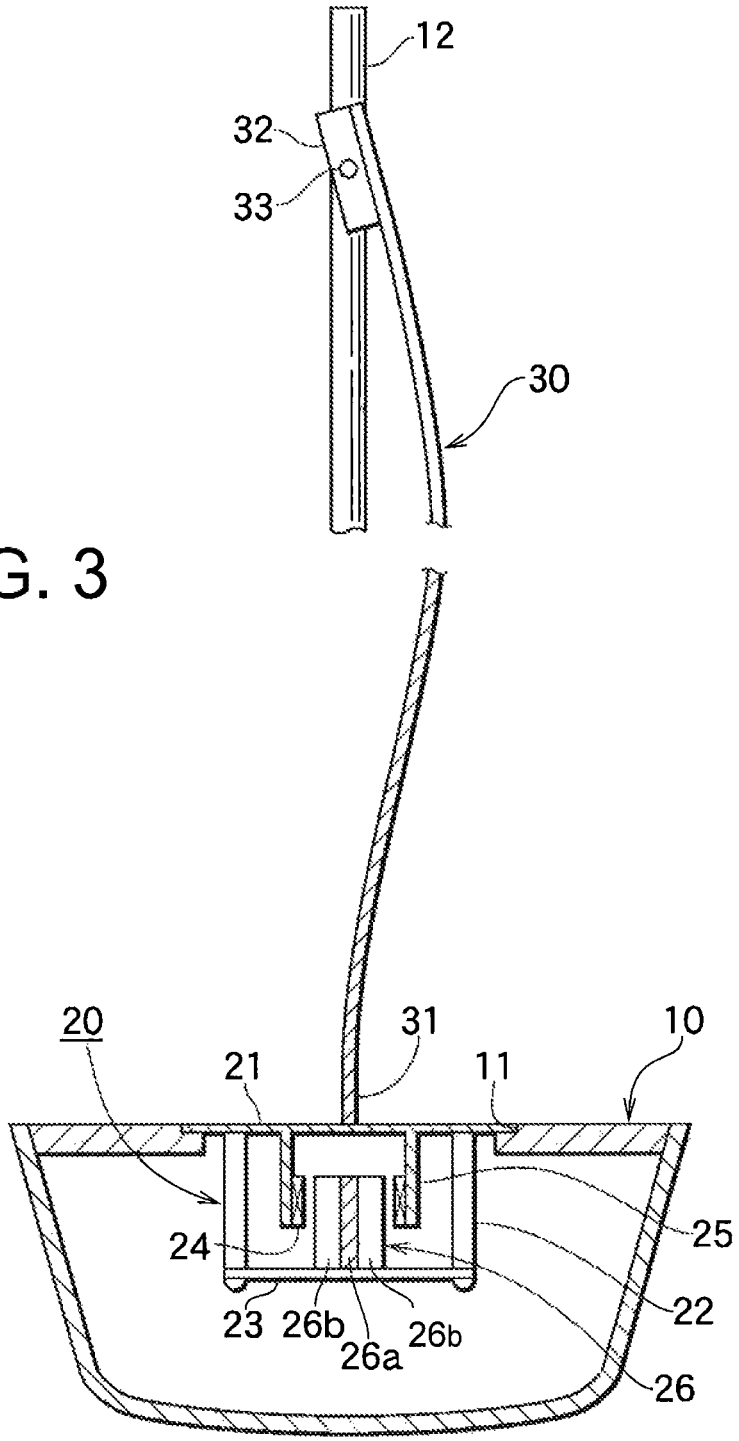
FIG. 3 depicts a cross-sectional view taken along III-III of FIG. 2.

As shown in FIGS. 1 to 3, the speaker device as an embodiment includes a hollow case 10, at least one drive unit 20 housed in the case 10, at least one curved diaphragm 30 having a flat plate curved and arranged to stand in an upright position on an upper surface of the case 10.

The speaker device is configured such that, by driving the drive unit 20, sound having a low-frequency range, a mid-frequency range, and a high-frequency range can be emitted through three vibrating members, i.e., the case 10, the curved diaphragm 30, and the drive unit 20.

Sound emitted from the speaker device does not have directivity so that sound field feelings can be substantially the same in all places irrespective of the orientation of the curved diaphragm 30 and the like.

In this embodiment, the descriptions will be provided for the speaker device shaped as a sailing ship having the case 10 shaped as a streamlined hull in plan view and the curved diaphragm 30 shaped as a substantially triangular sail. However, the respective shapes and the respective numbers of the case 10 and the curved diaphragm 30 are not limited to those shown in the drawings. The speaker device may have a shape except a sailing ship as long as it includes the case 10, the drive unit 20, and the curved diaphragm 30.

Hereinafter, detailed descriptions of components will be provided.

[2] Case

The case 10 is a hermetically-closed hollow case having a bottom surface, an upper surface, and a side surface. An opening 11 is formed in the upper surface for installation of the drive unit 20.

The hollow structure of the case 10 is intended to enhance sound emission performance of the case 10.

[2.1] Sound Emission Feature of Case

The hollow structure of the case 10 enables clear sound having a low-frequency range to be emitted. By hermetically closing the case 10, sound emission performance of the case 10 is further enhanced.

[2.2] Standing Pole

At least one standing pole 12 imitating a mast in shape is provided in an upright position on the upper surface of the case 10.

The standing pole 12 is configured to receive reactive force from the case 10 so as to hold the upper end of the curved diaphragm 30 thereby serving the function of maintaining the curved diaphragm 30 at a curved deformation state.

The standing pole 12 is not limited to that in a pole shape but it may also be in a plate shape or in a string shape as long as it can maintain the curved deformation sate of the curved diaphragm 30.

[2.3] Accessories

Although not shown in the drawings, by routing a plurality of auxiliary ropes between the upper surface of the case 10 and the upper part of the standing pole 12, the stability of the standing pole 12 is further enhanced.

In order to render the speaker device as having the impression closer to that of a sailing ship, appropriate accessories may be added to the case 10, if necessary.

[3] Curved Diaphragm

The curved diaphragm 30 is a curved thin plate obtained by pressing the thin plate at an upper part thereof and a lower part thereof. The curved diaphragm 30 has a tongue strip 31 formed at a lower side thereof such that the tongue strip 31 extends downward. An essential structure is not the tongue strip 31 but a structure where a part of the lower side of the curved diaphragm 30 can abut directly on a diaphragm 21 of the drive unit 20.

The curved diaphragm 30 is maintained at a deformation state by pressing the curved diaphragm 30 at an upper part thereof and a lower part thereof. Unlike a conventional structure, therefore, the addition of a plurality of reinforcing ribs is not needed for maintaining the curved diaphragm 30 at a deformation state.

[3.1] Reasons for Deforming Diaphragm Under Pressure

In a conventional plane-shaped speaker device, a diaphragm is maintained in a curved shape by adhesively attaching to one side thereof a plurality of reinforcing ribs each having arcuate surface. The reinforcing ribs restrain deformation stress of the diaphragm in the speaker device, which results in hindering vibration of the diaphragm.

If a flat-plate shaped diaphragm without a curvature is used as it is, a resultant sound volume is limited to a low range.

In an embodiment according to the present invention, in order to solve the above problems, a single flat plate is pressed at an upper end portion thereof and a lower end portion thereof to form the curved diaphragm 30 having a curved shape.

By pressing a not-yet-curved plate at an upper end portion thereof and a lower end portion thereof to obtain the curved diaphragm 30, a volume of sound transmitted therethrough can be increased. A sound volume can be remarkably increased with respect to the curved diaphragm 30 rather than a non-curved diaphragm that is the same in shape and in size as a not-yet-curved plate of the curved diaphragm 30.

A sound volume generated by the curved diaphragm 30 can be increased depending on the degree of curvature but is not completely proportional thereto. For example, a curvature set to the extent shown in FIG. 1 or 3 is sufficient for the purpose of sound volume.

[3.2] Attachment Configuration at Lower End of Curved Diaphragm

The bottom surface of the tongue strip 31 formed at the lower side of the curved diaphragm 30 abuts directly on the diaphragm 21 on the upper surface of the drive unit 20. Accordingly, vibration (longitudinal wave) of the diaphragm 21 in a vertical direction is transmitted as vibration (transverse wave) in a horizontal direction to the curved diaphragm 30.

[3.3] Attachment Configuration at Upper End of Curved Diaphragm

While causing the tongue strip 31 to abut on the diaphragm 21, downward force is applied to the upper part of a not-yet-curved plate of the curved diaphragm 30 to curve the entire plate, and the upper end of the curved diaphragm 30 thus obtained is fixed to the upper part of the standing pole 12 to maintain the curved diaphragm 30 at a deformation sate.

Regarding the attachment configuration at the upper end of the curved diaphragm 30 as shown in FIGS. 2 and 3, a thick stiffening plate 32 added thereto is fixed to the upper part of the standing pole 12 with a screw 33.

Attachment means for the above attachment at the upper part of the curved diaphragm 30 is not limited to the screw 33 for fixation. Publicly known fixation means is applicable as long as it can maintain the curved diaphragm 30 at a state under pressure.

[3.4] Sound Emission Feature of Curved Diaphragm

The curved diaphragm 30 does not have a reinforcing rib as a vibration attenuating element, and is curved by compression force acting therethrough as a whole. Further, vibration of the drive unit 20 is transmitted to the diaphragm 21 and is then transmitted directly to the lower side of the curved diaphragm 30. As a result, sound having a mid-frequency range and a high-frequency range in particular can be emitted clearly.

[4] Material for Case and Curved Diaphragm

As a material for the case 10 and the curved diaphragm 30, one of plates such as a wood plate, a metallic plate, and a resin plate, or a combination thereof is applicable.

Figure 4:
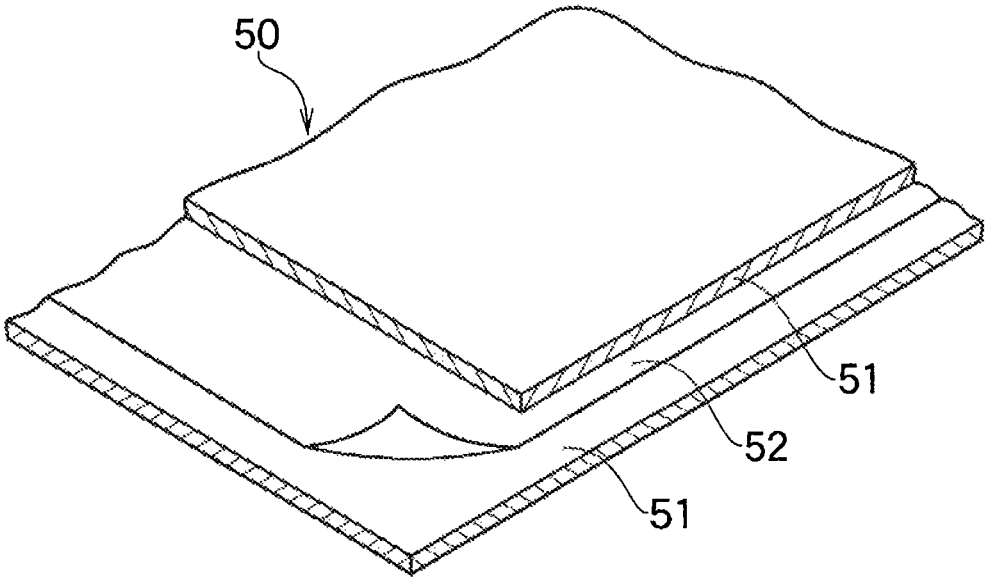
FIG. 4 depicts an explanatory view of an example of a material.

In terms of sound quality and sound volume in particular, a wood plate 50 having a plurality of thin plates 51 in a multilayered fashion as shown in e.g. FIG. 4 is preferred.

When the wood plate 50 is used as the curved diaphragm 30, the respective wood grains (fiber directions) of the plurality of thin plates 51 are aligned in a vertical direction in such a fashion that the curved diaphragm 30 can be resistant to bending across the grains.

[4.1] Feature of Paulownia Wood Material

As a result of having examined various sorts of wood material at home and overseas, it has turned out that paulownia wood material is the most suitable material for the case 10 and the curved diaphragm 30.

Paulownia wood material excels not only in clearness of sound but also in transparence, softness, and warmth of sound in comparison with other sorts of wood material.

On the other hand, paulownia wood material is lightweight and is easy to process; nevertheless, the feature thereof is that the material in the form of thin plate is easy to crack if it is bent by applying pressure at an upper part thereof and a lower part thereof, whereas the material in the form of thick plate is not easy to be bent.

[4.2] Countermeasures Against Crack of Thin Plate

If paulownia wood material is used as a thin plate, countermeasures should be taken against a crack thereof.

As shown in FIG. 4, a multilayered body is formed by interposing a flexible reinforcing sheet 52 between a pair of adjacent thin plates 51 made of paulownia wood material, and adhesively connecting them, thereby preventing a crack of the thin plates 51 reliably while allowing the thin plates 51 to be deformed largely.

As an example, Japanese paper or non-woven fabric is applicable as the reinforcing sheet 52. In terms of acoustic aspect, thickness, or the like, Japanese paper is the most preferable material.

[4.3] Method of Manufacturing Wood Plate

As an exemplary method of manufacturing the wood plate 50, pieces of paulownia wood material are thinned to those having a predetermined thickness, and thereafter Japanese paper is interposed between two thin paulownia wood plates whose wood grains (fiber directions) are aligned in the same direction, and the two thin paulownia wood plates are adhesively and thermally connected under pressure, thereby forming the wood plate 50 made of paulownia wood material.

The wood plate 50 made of paulownia wood material can be deformed easily and can be cut easily, and therefore, by using such a wood plate 50, the case 10 and the curved diaphragm 30 each having curve geometry can easily be formed.

[4.4] Number of Multilayered Thin Plates

In this embodiment, one reinforcing sheet 52 is interposed between two thin plates 51 to form the wood plate 50. The number of the thin plates 51 to form the wood plate 50 may be three or more.

[5] Drive Unit

The drive unit 20 is configured to cause the case 10 and the curved diaphragm 30 to emit sound, and is suspended from the upper surface of the case 10.

The drive unit 20 is electrically connected to an amplifier (not shown).

As shown in FIG. 3, an example of the drive unit 20 includes, in a state where the drive unit 20 is suspended from the upper surface of the case 10: an aluminum frame 22; the diaphragm (vibratory plate) 21 made of aluminum and fixedly attached to the upper end of the frame 22; a magnetic circuit attachment plate 23 fixedly attached to the bottom end of the frame 22; a bobbin 25 with a coil 24 fixedly attached to the back surface of the diaphragm 21; and a magnetic circuit 26 arranged on the upper surface of the magnetic circuit attachment plate 23.

[5.1] Diaphragm

The diaphragm 21 is exposed from the opening 11 in the upper surface of the case 10.

The diaphragm 21 is exposed entirely in order to cause the diaphragm 21 itself to emit sound.

[5.2] Coil

The bobbin 25 attached fixedly to the lower surface of the diaphragm 21 has the coil 24 arranged in an opening at a lower part of the bobbin 25 so as to surround the magnetic circuit 26.

A predetermined gap is formed between the magnetic circuit 26 and the coil 24.

[5.3] Magnetic Circuit

The magnetic circuit 26 includes a plate-like iron yoke 26*a* and plate-like permanent magnets 26*b* arranged on opposite sides of the iron yoke 26*a*.

For example, a neodymium magnet, an alnico magnet, a ferrite magnet, or samarium-cobalt is applicable as the permanent magnets 26*b*, of which the neodymium magnet is preferred in terms of practical use.

[5.4] Feature of Drive Unit

Unlike a general speaker unit, the drive unit 20 of this embodiment is configured such that the diaphragm 21 and the coil 24 are fixed to the frame 22 thereby allowing vibration having a high frequency to be transmitted to the diaphragm 21, and subsequently providing the curved diaphragm 30 directly with vibration in a vertical direction.

The magnetic circuit 26 is attached to the upper surface of the magnetic circuit attachment plate 23 through a spring (not shown), and is configured to transmit vibration having a low frequency to the case 10 by means of reaction generated during vibration of the diaphragm 21.

(Action)

Hereinafter, the action of the above speaker device will be described.

[1] Action of Emitting Sound Through Curved Diaphragm

When the drive unit 20 shown in FIGS. 2 and 3 is driven, the diaphragm 21 vibrates in a vertical direction and the vibration is transmitted through the tongue strip 31 to the curved diaphragm 30.

Accordingly, the vibration of the diaphragm 21 is transmitted directly to the curved diaphragm 30, which results in remarkable reduction of loss of vibration to be transmitted between the diaphragm 21 and the curved diaphragm 30.

The curved diaphragm 30 is pressed at an upper end thereof and a lower end thereof. Accordingly, the vibration of the diaphragm 21 in a vertical direction is transmitted to the curved diaphragm 30, thereby emitting sound having a mid-frequency range and a high-frequency range corresponding to vibration (transverse wave) in the horizontal direction.

In particular, the curved diaphragm 30, which is curved as a whole, does not have any accessories such as a rib to attenuate vibration, and pressing force always acts through the whole of the curved diaphragm 30, thereby achieving emission of large and clear sound.

This embodiment having two sets of the curved diaphragm 30 and the drive unit 20 arranged in a lateral direction can form a two-way speaker.

[2] Action of Emitting Sound Through Case

Reaction generated during vertical vibration of the diaphragm 21 of the drive unit 20 is transmitted to the hollow case 10.

The hollow case 10 vibrates to emit sound having a low-frequency range through the case 10.

The case 10 is caused to vibrate by use of reaction of the drive unit 20, and therefore there is no necessity to add a drive unit dedicated to a low-frequency range inside the case 10, which results in reducing a component count for the speaker device as well as reducing manufacturing cost.

[3] Action of Emitting Sound Through Drive Unit

The diaphragm 21 of the drive unit 20 is exposed at the upper surface of the case 10.

As a result, sound having a mid-frequency range and a high-frequency range is emitted through the diaphragm 21.

(Feature of Speaker Device)

Hereinafter, other features of the speaker device will be described.

[1] First Feature

Sound from the curved diaphragm 30, the case 10, and the diaphragm 21 do not interfere with each other, and therefore sound having a low-frequency range, a mid-frequency range, and a high-frequency range can be reproduced clearly.

Not only sound having a plurality of audio frequency ranges can be reproduced clearly at high quality without addition of a conventional horn-shaped or cone-shape speaker, but also sound having a plurality of audio frequency ranges can still be reproduced more clearly at higher quality in comparison with sound reproduced with addition of a conventional horn-shaped or cone-shape speaker.

A conventional speaker device had technical difficulties in reproducing sound of a plurality of different audio frequency ranges through the diaphragm 21 of one drive unit 20.

According to this embodiment, sound having a plurality of different audio frequency ranges can be reproduced through the diaphragm 21 of one drive unit 20. As a result, there are achieved not only the effects that sound having a high-frequency range or an ultra-high frequency range such as that in music played with a stringed instrument and that in an opera can be clearly reproduced mainly through the curved diaphragm 30 but also the effects that sound having a low-frequency range or an ultra-low frequency range such as drum sound and base sound can be clearly and dynamically reproduced.

[2] Second Feature

It has been known that sound having transverse wave has no directivity and such a sound can act effectively on hearing-impaired persons and persons having lost their eardrums. According to this embodiment, clearer sound having transverse wave can be emitted through three pieces of media including the curved diaphragm 30, the case 10, and the diaphragm 21.

As a result, the speaker device of this embodiment enables a person to perceive sound of an ultra-high frequency range via the body (skin) thereof, which sound is contained in sounds in the natural world and cannot be perceived via the ears of the person. Furthermore, increase in the sound volume does not cause sound clipping.

[3] Third Feature

If a person tries to make conversation in an environment where loud sound is emitted from a conventional speaker device with a plurality of horn-shaped or corn-shaped speakers, both the sound and the conversation are transmitted to the eardrums of the person so that the sound interferes with the conversation.

In contrast, sound emitted from the speaker device of this embodiment is not a compression wave (longitudinal wave) in the air but a transverse wave. As a result, the person can perceive sound not only via an auditory sense but also via the body (skin) thereof, thereby capable of easily distinguishing between sound from the speaker device and a human voice in conversation. The person can therefore make conversation without feeling discomfort with sound from the speaker device.

A detailed factor for the above effects is now being examined, whereas the effectiveness of this effect has been confirmed by a proving test.

[4] Fourth Feature

The speaker device is shaped as a sailing ship so that it can also serve as an interior ornament of a sailing ship when not emitting sound.

Sound is emitted from a sailing ship if the speaker device serves the intrinsic function as a speaker device. As a result, the healing effect perceived via a sense of sight can be achieved, and, in addition, sound can be perceived by a person not only via an auditory sense but also via the body (skin) thereof.

[5] Preferred Usage

The speaker device of this embodiment can be used for various publicly known purposes.

In particular, the speaker device of this embodiment is used preferably for places, in which healing and peace-of-mind effects are considered as important, such as hospitals, various clinics, offices, restaurants, waiting rooms, bedrooms, and the like.

| (Reference Numerals) | | |
|---|---|---|
| 10 case | 11 opening | 12 standing pole |
| 20 drive unit | 21 diaphragm | 30 curved diaphragm |
| 31 tongue strip | 50 wood plate | 51 thin plate |
| 52 reinforcing sheet | | |

What is claimed is:

1. A speaker device comprising: a case having a hollow structure; at least one drive unit housed in the case, the at least one drive unit configured to cause a diaphragm to vibrate; and at least one curved diaphragm having a flat plate curved and arranged to stand in an upright position on an upper surface of the case, wherein said speaker device is configured such that the diaphragm of the at least one drive unit is exposed at a part of a surface of the case, and that a bottom surface of a tongue strip causes a part of a base end of the at least one curved diaphragm to project downward and abuts on the diaphragm of the at least one drive unit, and the at least one curved diaphragm is compressively deformed through a standing pole arranged to extend between a tip end of the at least one curved diaphragm and the case, whereby vibration of the diaphragm of the at least one drive unit is allowed to propagate to the at least one curved diaphragm and the case, so that sound is allowed to come out of the diaphragm of the at least one drive unit, the at least one curved diaphragm, and the case, wherein sound having a mid-frequency range and a high-frequency range is emitted through the at least one curved diaphragm, and sound having a low-frequency range is emitted through the case by use of reaction generated during vibration of the diaphragm of the at least one drive unit.

2. The speaker device according to claim 1, wherein the at least one curved diaphragm and the case are made of a wood plate, and the wood plate includes a multilayered body having a plurality of thin plates and a plurality of reinforcing sheets each interposed between thin plates of the plurality of thin plates.

3. The speaker device according to claim 2, wherein the plurality of thin plates are made of paulownia wood material, and the plurality of reinforcing sheets are made of Japanese paper.

4. The speaker device according to any one of claim 1, wherein the at least one curved diaphragm is shaped as a substantially triangular sail, and the case is shaped as a hull, whereby said speaker device is shaped as a sailing ship.

5. The speaker device according to any one of claim 2, wherein the at least one curved diaphragm is shaped as a substantially triangular sail, and the case is shaped as a hull, whereby said speaker device is shaped as a sailing ship.

6. The speaker device according to any one of claim 3, wherein the at least one curved diaphragm is shaped as a substantially triangular sail, and the case is shaped as a hull, whereby said speaker device is shaped as a sailing ship.

* * * * *